US006199630B1

(12) United States Patent
Blundell et al.

(10) Patent No.: US 6,199,630 B1
(45) Date of Patent: Mar. 13, 2001

(54) PULL-THROUGH TUBING STRING ROTATOR FOR AN OIL WELL

(75) Inventors: Chris C. Blundell, Calgary; Andrew J. Wright, Leduc; Curtis P. Ring, Okotoks, all of (CA)

(73) Assignee: Alberta Basic Industries, Ltd., Calgary (CA)

( * ) Notice: Subject to any disclaimer, the term of this patent is extended or adjusted under 35 U.S.C. 154(b) by 0 days.

(21) Appl. No.: 09/257,007

(22) Filed: Feb. 25, 1999

(51) Int. Cl.[7] ..... E21B 33/04
(52) U.S. Cl. ..... 166/78.1; 166/75.14
(58) Field of Search ..... 166/78.1, 75.13, 166/75.14, 77.51, 104, 382

(56) References Cited

U.S. PATENT DOCUMENTS

| | | | | |
|---|---|---|---|---|
| 2,694,450 | * | 11/1954 | Osbun | 166/75.14 |
| 5,383,519 | | 1/1995 | Wright | 166/78.1 |
| 5,427,178 | * | 6/1995 | Bland | 166/78.1 |
| 5,465,788 | | 11/1995 | Wright | 166/78.1 |
| 5,732,777 | | 3/1998 | Grimshaw | 166/382 |
| 5,875,841 | * | 3/1999 | Wright et al. | 166/78.1 X |
| 5,964,286 | * | 10/1999 | Cuppen | 166/78.1 |
| 6,026,898 | * | 2/2000 | Bland et al. | 166/78.1 |

* cited by examiner

*Primary Examiner*—George Suchfield
(74) *Attorney, Agent, or Firm*—Merek & Voorhees

(57) ABSTRACT

An apparatus for rotating a tubing string within an oil well. The apparatus includes an outer housing having an upper end, a lower end and a generally hollow interior where the lower end may be used to attach the outer housing to the casing bowl of an oil well. The apparatus further includes a drive assembly and a tubing string hanger generally disposed within the interior of the outer housing. The drive assembly has a generally hollow rotating gear mandrel and a drive gear. The tubing string hanger has a lower end for attaching to and supporting a tubing string. The tubing string hanger engages the rotating gear mandrel such that rotation of the rotating gear mandrel causes rotation of the tubing string hanger. The tubing string hanger, and a tubing string attached thereto, may be withdrawn from the oil well and through the outer housing without withdrawal of the rotating gear mandrel or the drive gear.

14 Claims, 3 Drawing Sheets

PULL-THROUGH TUBING STRING ROTATOR FOR AN OIL WELL

FIELD OF THE INVENTION

This invention relates to an apparatus for rotating a tubing string within an oil well, and in particular such an apparatus that readily provides for the removal of a tubing string from the oil well by pulling the string through the rotating apparatus.

BACKGROUND OF THE INVENTION

It is well known that through rotating a tubing string in an oil well, the wear that typically occurs on the inside surface of the tubing string caused by sucker rod movement can be reduced or more evenly distributed around the interior surface of the string, thereby significantly extending the life of the string. A variety of different devices have been proposed by others in order to rotate the tubing string. Typically, such devices, or rotators as they are commonly known, are bolted or otherwise attached to the top of an oil well and connected in some manner to the tubing string to cause the string to rotate. In some instances the tubing string may be hung directly from the rotator, while in others a hanging apparatus may effectively hang the tubing string from the well casing. The hanging device would then most often be engaged by a rotator to turn the string.

While such prior art devices are relatively effective in distributing wear around the interior surface of the tubing string, there is little or no standardization of the size of the casing bowls that tubing hangers fit into. There is therefore a need for a wide variety of different tubing string hangers and rotators to match the size of the various different casing bowls that are used. Furthermore, the design of present rotators necessitates that they be completely removed from the oil well in order to withdraw the tubing string, or to remove the downhole pump for servicing or replacement. In many cases the tubing string of an oil well must be pulled as often as every two months in order to repair worn parts or leaks, or to service the pump. Removing the rotator from the wellhead in order to pull the string and the pump increases the amount of labour and equipment required for servicing the well, and also extends the down-time of the well and results in further lost production.

SUMMARY OF THE INVENTION

The invention therefore provides an apparatus for rotating a tubing string within an oil well which permits the tubing string, and a downhole pump attached thereto, to be readily withdrawn from the well without the necessity of removing the entire rotator. The device may also be readily used on casing bowls of a variety of different sizes.

Accordingly, in one of its aspects the invention provides an apparatus for rotating a tubing string within an oil well, the apparatus comprising an outer housing having an upper end, a lower end and a generally hollow interior, said lower end having means for attaching said outer housing to the casing bowl of an oil well; a drive assembly generally disposed within the interior of said outer housing, said drive assembly including a generally hollow rotating gear mandrel and a drive gear; and, a tubing string hanger disposed within said generally hollow interior of said outer housing, said tubing string hanger having a lower end with means for attaching to and supporting a tubing string, said tubing string hanger further having means to operatively engage said tubing string hanger and said rotating gear mandrel such that rotation of said rotating gear mandrel causes rotation of said tubing string hanger, said means to operatively engage said rotating gear mandrel allowing said tubing string hanger, and a tubing string attached thereto, to be withdrawn from the oil well and through said outer housing without withdrawal of said rotating gear mandrel or said drive gear.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
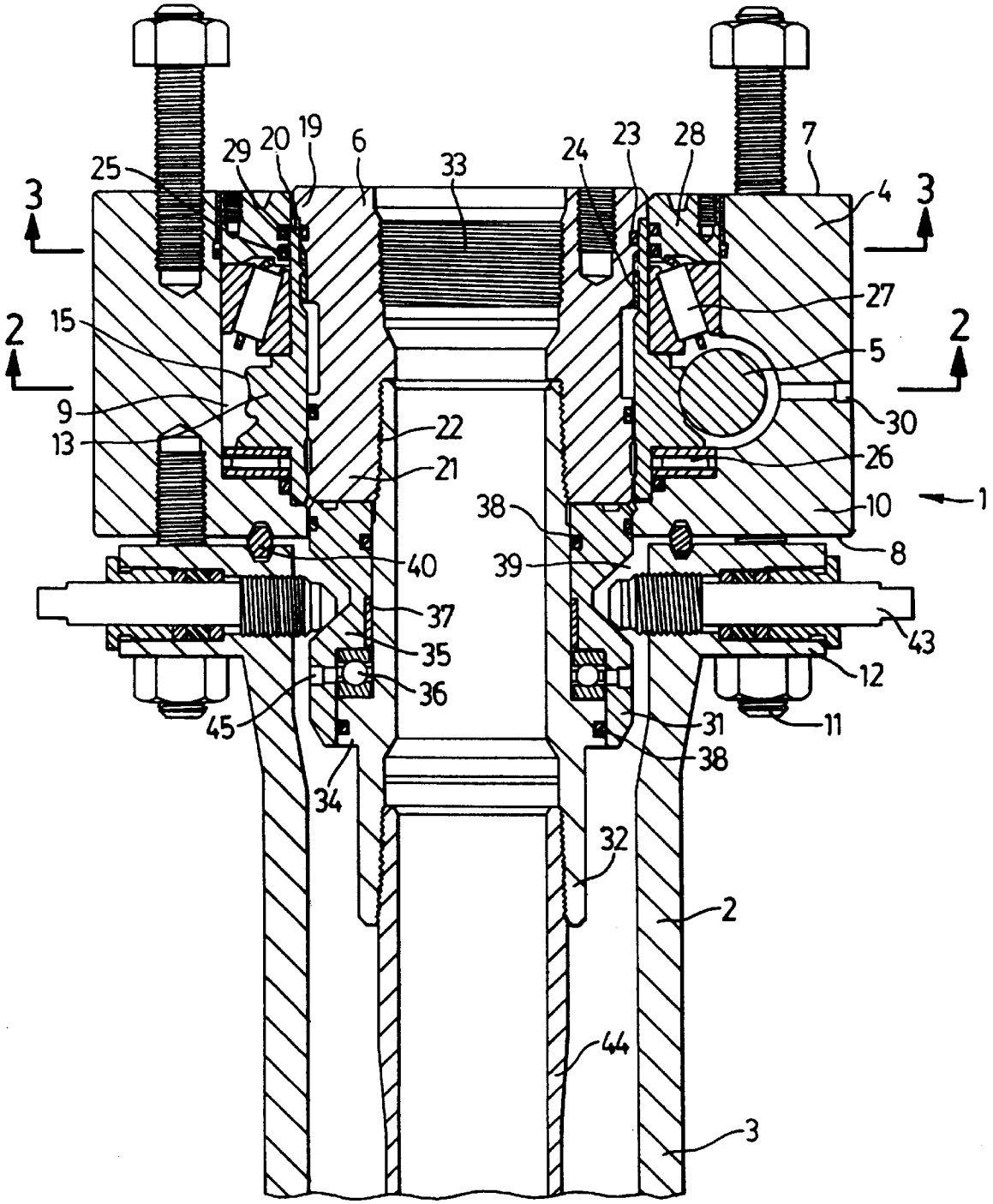
FIG. 1 is a side elevational view in longitudinal section of an apparatus for rotating a tubing string within an oil well in accordance with the present invention.

In the accompanying drawings, and specifically in FIG. 1, the pull-through tubing string rotator of the present invention is noted generally by the reference numeral 1. FIG. 1 shows rotator 1 as it may be attached to the casing bowl 2 of a wellhead 3. While rotator 1 is formed from a number of different parts, it is comprised of three major components; namely, an outer housing 4, a drive assembly 5, and a tubing string hanger 6. Outer housing 4 has an upper end 7, a lower end 8 and a generally hollow interior 9 that receives drive assembly 5 and tubing string hanger 6. In the preferred embodiment, lower end 8 of outer housing 4 includes means 10 to attach the housing to wellhead 3. While a wide variety of mechanisms for attaching the housing to the wellhead could be employed, typically the outer housing would be secured by way of a series of bolts or threaded studs 11 to a flange 12 that is either threaded onto the top of casing bowl 2 or that is an integral part of the casing bowl. A wellhead seal 40 prevents the loss of fluids and from between the wellhead and the bottom of outer housing 4.

Figure 2:
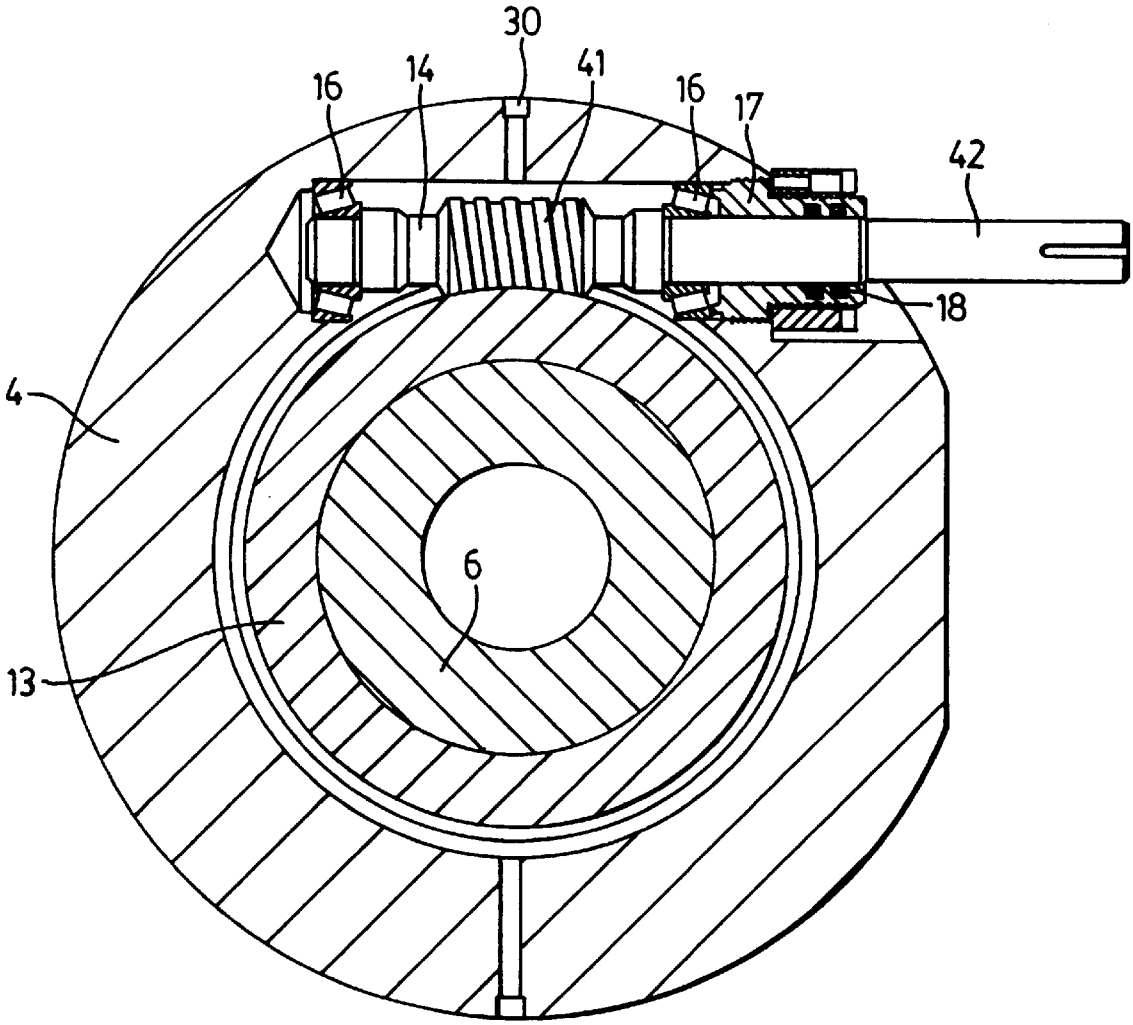
FIG. 2 is a sectional view taken along the line 2—2 of FIG. 1.

Drive assembly 5 includes a generally hollow rotating gear mandrel 13 and a drive gear 14. As is shown more clearly in FIG. 2, drive gear 14 preferably comprises a worm gear 41 positioned on a shaft 42. Worm gear 41 meshes with an annular gear 15 on the exterior surface of rotating gear mandrel 13 such that rotation of the worm gear results in a corresponding rotation of the rotating gear mandrel. A pair of bearings 16 are utilized in order to maintain the position of shaft 42 and to facilitate in its rotation. A retaining nut 17 prevents lateral movement of the shaft within outer housing 4, and also provides a means for removal of the worm gear and bearings 16 for servicing purposes. Seals 18 are disposed between retaining nut 17 and drive gear 14.

Referring again to FIG. 1, tubing string hanger 6 is disposed and hung within the generally hollow interior of outer housing 4, and more particularly within the hollow interior of rotating gear mandrel 13. In the preferred embodiment, tubing string hanger 6 includes an outwardly extending radial shoulder 19 that is received over the upper end 20 of rotating gear mandrel 13. In this manner, when tubing hanger 6 is received within rotating gear mandrel 13, shoulder 19 rests upon or bears against upper end 20 such that tubing string hanger 6 is effectively supported by, or hung from, the rotating gear mandrel. The downward thrust load of both tubing string hanger 6 and the tubing string will therefore be transmitted through shoulder 19 and borne by the rotating gear mandrel.

Tubing string hanger 6 further includes a lower end 21 having means for attaching and supporting a tubing string 44. Typically the means to attach and support the tubing string will comprise a threaded bore 22 into which a portion of the tubing string, or a tubing string adaptor or nipple, can be threaded and supported therefrom. One or more seals 23 are located between tubing string hanger 6 and rotating gear mandrel 13 to prevent the leakage of fluids therebetween, and to maintain well control.

Figure 3:
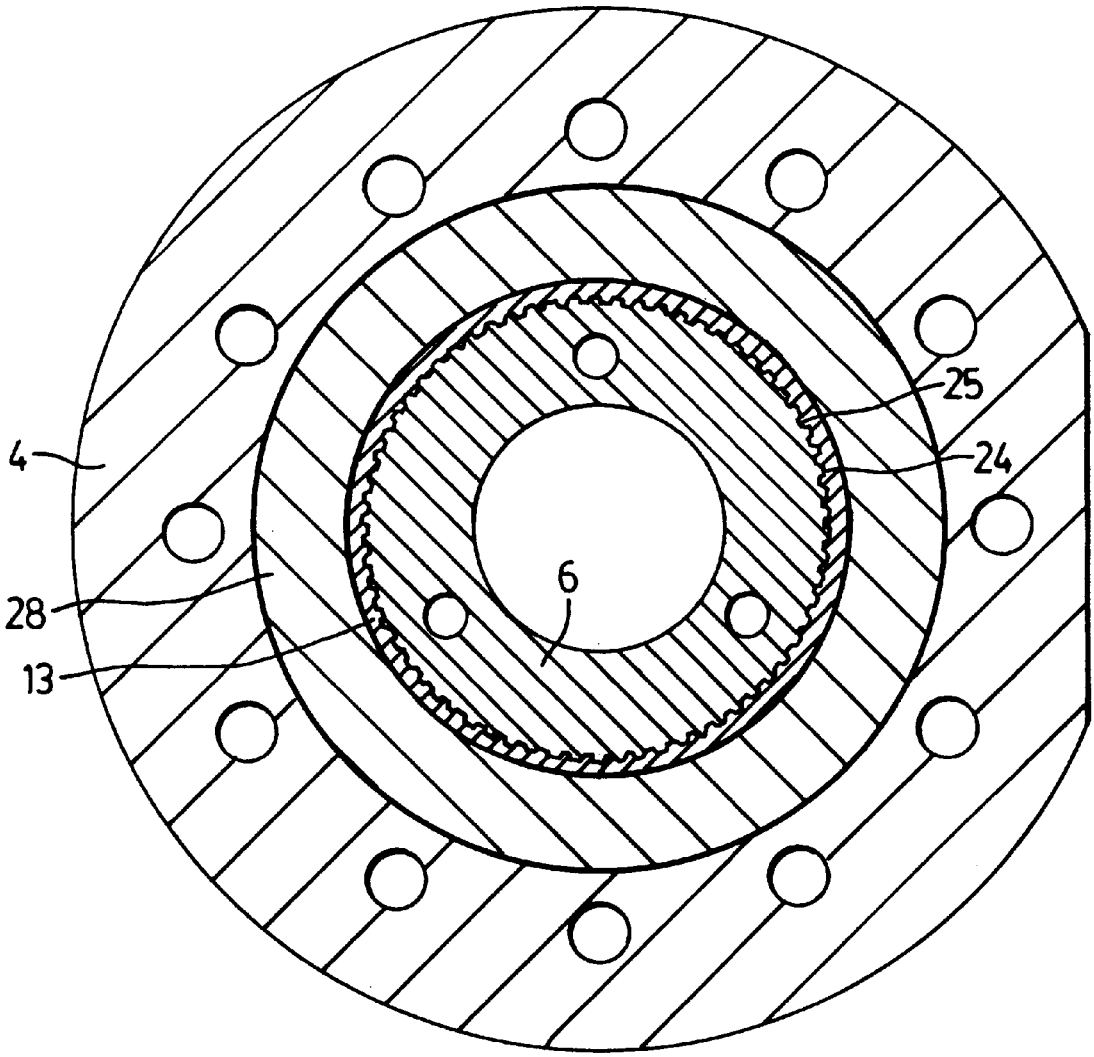
FIG. 3 is a sectional view taken along the line 3—3 of FIG. 1.

Tubing string hanger 6 further includes means to operatively engage rotating gear mandrel 13 such that rotation of the gear mandrel causes rotation of the tubing string hanger, and the resulting rotation of the tubing string attached thereto. The engagement of the tubing string hanger with the rotating gear mandrel further permits the tubing string hanger, and a tubing string attached thereto, to be withdrawn from the oil well, and through outer housing 4, without withdrawal of rotating gear mandrel 13 or drive gear 14. Referring specifically to FIGS. 1 and 3, in the preferred embodiment the means to operatively connect tubing string hanger 6 with rotating gear mandrel 13 comprises a set of outwardly extending longitudinally oriented splines 24 on tubing string hanger 6, and a set of corresponding inwardly extending longitudinally oriented splines 25 on rotating gear mandrel 13. When tubing string hanger 6 is received within and hung from rotating gear mandrel 13, splines 24 mesh or engage with splines 25 such that rotation of the rotating gear mandrel causes rotation of the tubing string hanger. It will therefore be appreciated that through forming rotating gear mandrel 13 with an interior diameter that exceeds that of both the tubing string and a downhole pump or tool attached thereto, the entire tubing string and any attached downhole tool or pump can be easily withdrawn from the well, without disturbing the rotating gear mandrel or the other internal mechanisms of the drive assembly. Full well control is provided by seals 23.

Since tubing string hanger 6 is effectively hung from rotating gear mandrel 13, the entire weight of the tubing string and the downhole pump is effectively borne by the rotating gear mandrel. For that reason a thrust bearing 26 is positioned between rotating mandrel 13 and outer housing 4 to transfer load to the outer housing, and to also allow for rotational movement of the mandrel. In addition, in the preferred embodiment a tapered roller bearing 27 is located between rotating gear mandrel 13 and outer housing 4 to accommodate side loading that will occur from torque from the drive gear, or wells that are slanted or that deviate from vertical. As shown in FIG. 1, tapered roller bearing 27 is positioned above both thrust bearing 26 and drive gear 14. A retaining nut 28 is threadably received into outer housing 4, above tapered roller bearing 27, in order pre-load the bearings and the drive assembly, and to maintain rotating gear mandrel 13 in position with its annular gear 15 engaging drive gear 14. Retaining nut 28 also allows for the easy removal and servicing of thrust bearing 26, tapered roller bearing 27 and rotating gear mandrel 13. Seals 29 are positioned between retaining nut 28 and rotating gear mandrel 13, and also between outer housing 4 and rotating gear mandrel 13, to effectively seal the interior portion of outer housing 4 that retains the bearings, drive assembly and lubricant, and to prevent exposure of the bearings and drive asembly to dirt, sand and other debris. A grease nipple 30 allows for the lubrication of the drive gear and the bearing assemblies during its operation.

Referring again to FIG. 1, apparatus 1 may further include a hold-down housing 31 to prevent tubing string hanger 6 from operatively disengaging from rotating gear mandrel 13 in high pressure or slanted wells. Hold-down housing 31 is positioned beneath tubing string hanger 6 and is held securely against the lower face of the tubing string hanger by means of a hold-down mandrel 32. Hold-down mandrel 32 is preferably threaded into bore 22 in tubing string hanger 6. An outwardly extending annular shoulder 34 on hold-down mandrel 32 engages an annular ledge 35 within hold-down housing 31 to effectively secure the hold-down housing in place. To facilitate in the rotation of hold-down mandrel 32 within hold-down housing 31, a thrust bearing 36 and a radial bearing or bushing 37 may be used. Seals 38 prevent sand and dirt from the well from contaminating bearings 36 and 37, and retain lubricant about the bearings. A grease nipple 45 allows for bearings and/or bushings 36 and 37 to be lubricated.

Hold-down housing 31 would most commonly be fixed to wellhead 3 through the use of a set of flange lock screws 43. The flange lock screws, when turned into the casing bowl, engage an annular groove 39 about the circumference of hold-down housing 31 and thereby prevent upward movement of housing 31. In this manner tubing string hanger 6 is kept from lifting upwardly out of rotating gear mandrel 13 in high pressure or slanted wells. Typically flange lock screws used on a wellhead have tapered ends and therefore in the preferred embodiment groove 39 has a generally V-shaped cross-section to receive the ends of the screws.

It will thus be understood that in high pressure or slanted wells, or where there is a possibility that vertical loading may disengage tubing string hanger 6 from rotating gear mandrel 13, the utilization of hold-down housing 31 and hold-down mandrel 32 will effectively secure the tubing string hanger in place and prevent its disengagement from the rotating gear mandrel and drive assembly. In such cases the tubing string may be threaded directly onto the lower portion of hold-down mandrel 32. In low pressure wells that are substantially vertical, it may not be necessary to utilize hold-down housing 31 and hold-down mandrel 32. In those instances the tubing string may be threaded directly into the lower portion of bore 33 in the tubing string hanger.

It will be appreciated by those skilled in the art that apparatus 1 provides a number of distinct advantages over prior devices. Through proper sizing of rotating gear mandrel 13 and tubing string hanger 6, the entire tubing string, and any down-hole pump or tool attached thereto, may be readily pulled from the well and through the rotator without removing or disturbing the internal mechanisms of the drive assembly. Removing the the tubing string from the well merely requires threading a lifting tool into the upper portion of bore 33 of the tubing string hanger and the application of a vertical lifting force to the lifting tool so as to disengage splines 24 on the hanger from splines 25 on rotating gear mandrel 13. There is no need to remove the rotator housing or its drive assembly as in prior devices. As a result, pulling the tubing string from the well is simplier, faster, and requires less equipment than with presently available rotators and tubing string hangers.

The structure of the present invention also effectively maintains drive gear 14, thrust bearings 26 and tapered roller bearings 27 in a sealed compartment so that they are not subjected to damage or wear when pulling the tubing string, nor are they subjected to corrosive well gases and fluids, or sand and particulate matter, from the well. The drive gear, thrust bearings and tapered roller bearings can also be more efficiently lubricated than would otherwise be possible in rotators with exposed drive assemblies. In addition, through the design of tubing string hanger 6, and its ability to be supported by rotating gear mandrel 13, there is no longer the necessity to support the tubing string hanger from the casing bowl as in prior devices. The present structure permits for the manufacturing and use of a single, universally sized, rotator and tubing string hanger for each tubing string and well casing size regardless of the particular size of casing bowl that is used.

It is to be understood that what has been described are the preferred embodiments of the invention and that it may be possible to make variations to these embodiments while staying within the broad scope of the invention. Some of these variations have been discussed while others will be readily apparent to those skilled in the art.

What is claimed is:

1. An apparatus for rotating a tubing string within an oil well, the apparatus comprising:

(i) an outer housing having an upper end, a lower end and a generally hollow interior, said lower end having means for attaching said outer housing to the casing bowl of an oil well;

(ii) a drive assembly generally disposed within the interior of said outer housing, said drive assembly including a generally hollow rotating gear mandrel and a drive gear; and, (iii) a tubing string hanger disposed within said generally hollow interior of said outer housing, said tubing string hanger having a lower end with means for attaching to and supporting a tubing string, said tubing string hanger further having means to operatively engage said tubing string hanger and said rotating gear mandrel such that rotation of said rotating gear mandrel causes rotation of said tubing string hanger, said means to operatively engage said rotating gear mandrel allowing said tubing string hanger, and a tubing string attached thereto, to be withdrawn from the oil well and through said outer housing without withdrawal of said rotating gear mandrel and said drive gear.

2. The device as claimed in claim 1 wherein said tubing string hanger is received within said generally hollow interior of said rotating gear mandrel thereby hanging said tubing string hanger from said rotating gear mandrel and transmitting downwardly oriented thrust load from said tubing string hanger to said rotating gear mandrel.

3. The device as claimed in claim 2, including sealing means between said tubing string hanger and said rotating gear mandrel to prevent leakage of fluid therebetween.

4. The device as claimed in claim 3 including bearing means disposed between said rotating gear mandrel and said outer housing.

5. The device as claimed in claim 4 wherein said bearing means includes at least one thrust bearing supporting said rotating gear mandrel within said outer housing.

6. The device as claimed in claim 5 wherein said bearing means includes at least one tapered roller bearing.

7. The device as claimed in claim 6 including sealing means between said rotating gear mandrel and said outer housing to prevent the leakage of fluid therebetween.

8. The device as claimed in claim 1 wherein said means to operatively engage said tubing string hanger and said rotating gear mandrel permits a downhole pump or tool, attached to the tubing string, to be withdrawn from the oil well and through said outer housing without withdrawal of said rotating gear mandrel or said drive gear.

9. The device as claimed in claim 1 wherein said means to operatively engage said tubing string hanger and said rotating gear mandrel comprises a set of splines extending radially outwardly on said tubing string hanger and a set of splines extending radially inwardly on said rotating gear mandrel such that when said tubing string hanger is hung from said rotating gear mandrel said splines on said tubing string hanger engage said splines on said rotating gear mandrel such that rotation of said rotating gear mandrel causes rotation of said tubing string hanger.

10. The device as claimed in claim 1 including a hold-down housing to prevent said tubing string hanger from operatively disengaging from said rotating gear mandrel when said device is used in conjunction with high pressure or slanted oil wells or when said tubing string hanger is subjected to upward loading.

11. The device as claimed in claim 10 wherein said hold-down housing is positioned beneath said tubing string hanger and is releasably securable to the casing bowl of an oil well.

12. The device as claimed in claim 11 including a hold-down mandrel joining said lower end of said tubing string hanger to a tubing string, said hold-down mandrel received within said hold-down housing.

13. The device as claimed in claim 12 wherein said hold-down mandrel includes outwardly extending radial shoulders that transmit upward loading on said hold-down mandrel to said hold-down housing.

14. The device as claimed in claim 13 including bearing and sealing means disposed between said hold-down mandrel and said hold-down housing.

* * * * *